US006928842B1

(12) United States Patent
Huang

(10) Patent No.: US 6,928,842 B1
(45) Date of Patent: Aug. 16, 2005

(54) COMBINATION LOCK WITH KEY OPENING MECHANISM

(75) Inventor: Chien-Chien Huang, Changhua (TW)

(73) Assignee: Glox Industry Co., Ltd., Changhua (TW)

( * ) Notice: Subject to any disclaimer, the term of this patent is extended or adjusted under 35 U.S.C. 154(b) by 0 days.

(21) Appl. No.: 10/988,095

(22) Filed: Nov. 11, 2004

(51) Int. Cl.[7] ..... E05B 37/02

(52) U.S. Cl. ..... 70/21; 70/25; 70/284; 70/285; 70/312; 70/29

(58) Field of Search ..... 70/21, 22, 24–29, 70/38, 45–47, 284, 285, 312, DIG. 71

(56) References Cited

U.S. PATENT DOCUMENTS

| | | | | |
|---|---|---|---|---|
| 5,782,113 | A * | 7/1998 | Chen | 70/28 |
| 5,901,587 | A * | 5/1999 | Chen | 70/28 |
| 6,082,155 | A * | 7/2000 | Su | 70/22 |
| 6,381,997 | B1 * | 5/2002 | Chen | 70/28 |
| 6,539,761 | B2 * | 4/2003 | Yang | 70/284 |
| 6,708,534 | B1 * | 3/2004 | Ruan | 70/38 A |
| 6,792,778 | B1 * | 9/2004 | Chen | 70/21 |
| 6,843,080 | B1 * | 1/2005 | Yu | 70/21 |
| 6,848,283 | B1 * | 2/2005 | Lin | 70/21 |
| 2004/0226323 | A1 * | 11/2004 | Ling et al. | 70/25 |
| 2005/0039500 | A1 * | 2/2005 | Yu | 70/25 |
| 2005/0039501 | A1 * | 2/2005 | Yu | 70/29 |
| 2005/0044901 | A1 * | 3/2005 | Yu | 70/25 |

* cited by examiner

*Primary Examiner*—Suzanne Dino Barrett
(74) *Attorney, Agent, or Firm*—Pro-Techtor International Services

(57) ABSTRACT

A combination lock comprises a first shackle, dials, a spring loaded member biased against the innermost dial, a second shackle comprising an inner arm, a moveable block pivotably coupled to the inner arm and including a spring and an opposite T-shaped slot, and a key opening mechanism aligned with the moveable block and comprising a shaft and a cross member. Inserting a key into the mechanism and turning the key will rotate the shaft and the cross member until the cross member is aligned with an opening of the slot such that pressing the second shackle will cause the inner arm to counterclockwise pivot about the member, move the moveable block outwards to compress the spring and dispose the cross member in the opening, and disengage the second shackle from the first shackle.

3 Claims, 6 Drawing Sheets

COMBINATION LOCK WITH KEY OPENING MECHANISM

FIELD OF THE INVENTION

The present invention relates to combination locks and more particularly to such a combination lock with a key opening mechanism so that a person may use a key to work the key opening mechanism that opens the lock if such is required due to, for example, forgetting of the correct combination.

BACKGROUND OF THE INVENTION

There have been numerous suggestions in prior patents about combination lock with a key opening mechanism so that a person may use a key to work the key opening mechanism that opens the lock if such is required due to, for example, forgetting of the correct combination. Such prior mechanisms, however, are relatively complex in constructions, costly to manufacture, trouble-prone, and unreliable in use. Thus, the need for improvement still exists.

SUMMARY OF THE INVENTION

It is an object of the present invention to provide a combination lock with a key opening mechanism so that a person may use a key to work the key opening mechanism that opens the lock if such is required due to, for example, forgetting of the correct combination.

To achieve the above and other objects, the present invention provides a combination lock comprising a housing comprising a cover having a plurality of first openings, and a base matingly coupled to the cover, the base including a recess, a first cavity besides the recess, a second cavity aligned with and being in communication with the first cavity, and an extended first shackle; a dial assembly provided in the recess and comprising a plurality of parallel dials partially projected from the first openings of the cover, each dial having a plurality of distinct indicia formed on its outer surface, and a spring loaded member biased against the innermost dial, the spring loaded member being moveable in response to a correct combination of the dials; a second shackle comprising an outer arm matingly engaged with an end of the first shackle when the lock is locked, an inner, intermediate convex portion biased against the spring loaded member, an inner arm extended above the second cavity, a hole formed at one end of the inner arm, and an outer, intermediate trigger portion; a moveable block provided in the second cavity and comprising a top pin inserted into the hole for forming a pivotal coupling to the second shackle, an aperture having a blind end, a resilient member received in the aperture and resiliently confined by the second cavity, and a T-shaped slot opposite the aperture, the slot having a second opening; and a key opening mechanism provided in the first cavity and comprising a keyhole, a protruded, rotatable shaft opposite the keyhole, the shaft being disposed across the second opening when the lock is locked, and a cross member formed at an end of the shaft, the cross member being disposed in the slot when the lock is locked, whereby in response to a correct combination of the dials pressing the trigger portion will cause the convex portion to compress the spring loaded member, counterclockwise pivot the outer arm about the pin, and disengage the outer arm from the first shackle; and inserting a key into the keyhole and turning the key will rotate both the shaft and the cross member until the cross member is aligned with the second opening such that subsequently pressing the trigger portion will cause the inner arm to counterclockwise pivot about the spring loaded member, move the moveable block outwards to compress the resilient member and move the second opening until the cross member disposes therein, and disengage the outer arm from the first shackle.

The above and other objects, features and advantages of the present invention will become apparent from the following detailed description taken with the accompanying drawings.

DETAILED DESCRIPTION OF THE PREFERRED EMBODIMENTS

Figure 1:
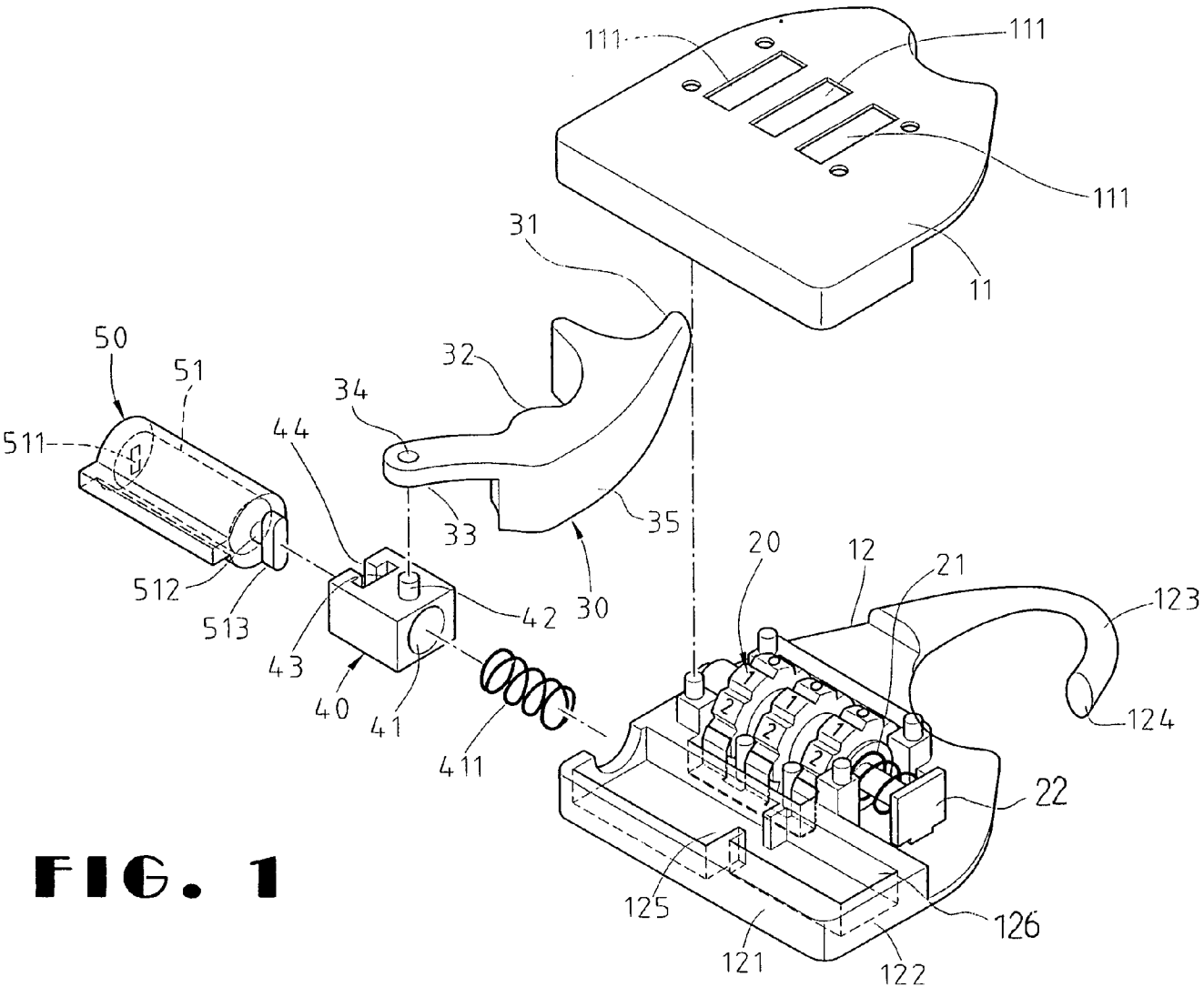
FIG. 1 is an exploded view of a preferred embodiment of combination lock according to the invention.
Figure 2:
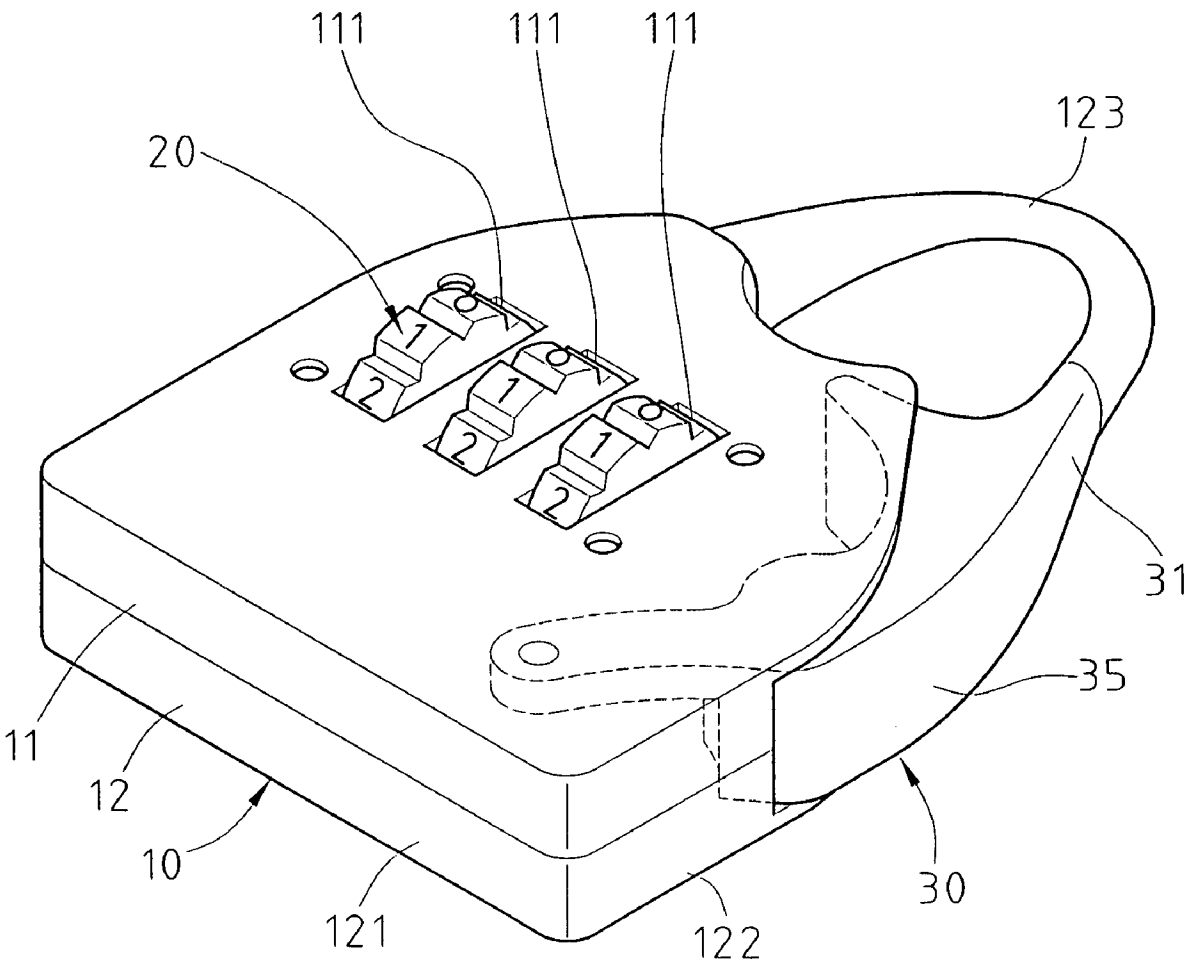
FIG. 2 is a perspective view of the assembled combination lock.

Referring to FIGS. 1 and 2, there is shown a combination lock constructed in accordance with a preferred embodiment of the invention comprising a housing 10, a dial assembly 20 provided in the housing 10, a second shackle 30 extended from the housing 10, a moveable block 40 provided in the housing 10, and a key opening mechanism 50 provided in the housing 10. Each component will be described in detailed below.

The housing 11 comprises a cover 11 having a plurality of (three as shown) rectangular openings 111, and a base 12 matingly coupled to the cover 11, the base 12 including a seat with the dial assembly 20 anchored therein, two opposite first walls 121 besides the dial assembly 20, two opposite second walls 122 perpendicular to the first walls 121 to define a first cavity 125 and a second cavity 126 therein in which the first cavity 125 is aligned with and is in communication with the second cavity 126, and a first shackle 123 extended from the base 12, the first shackle 123 having an open end 124.

The dial assembly 20 comprises a plurality of (three are shown) parallel dials partially projected from the openings 111, each dial having ten distinct indicia formed on its outer surface, and a coil spring 21 compressed between the innermost dial and a plate 22 which may move in response to a correct combination of the dial assembly 20.

The second shackle 30 comprises an outer arm 31 shaped to matingly engage with the open end 124 when the lock is locked, an inner, intermediate convex portion 32 biased against the plate 22, an inner arm 33 extended over the second wall 122 by a small distance as to be able to freely move above, a hole 34 in one end of the inner arm 33, and an outer, intermediate trigger portion 35.

The parallelepiped moveable block 40 is provided in the second cavity 126 and comprises a top pin 42 inserted into the hole 34 such that the second shackle 30 is able to pivot about the pin 42, a cylindrical aperture 41 having a blind end, a coil spring 411 received in the aperture 41 and resiliently confined by the second wall 122, and a T-shaped slot 43 opposite the aperture 41, the slot 43 having an opening 44.

The cylindrical key opening mechanism 50 is provided in the first cavity 125 and comprises a keyhole 51 having an opening 511, a protruded, rotatable shaft 512 opposite the opening 511, the shaft 512 being disposed across the opening 44 in a locked position of the lock, and a cross member 513 formed at an end of the shaft 512, the cross member 513 being disposed in the slot 43 in the locked position of the lock.

Opening operations of the combination lock will be described in detailed below.

Figure 3:
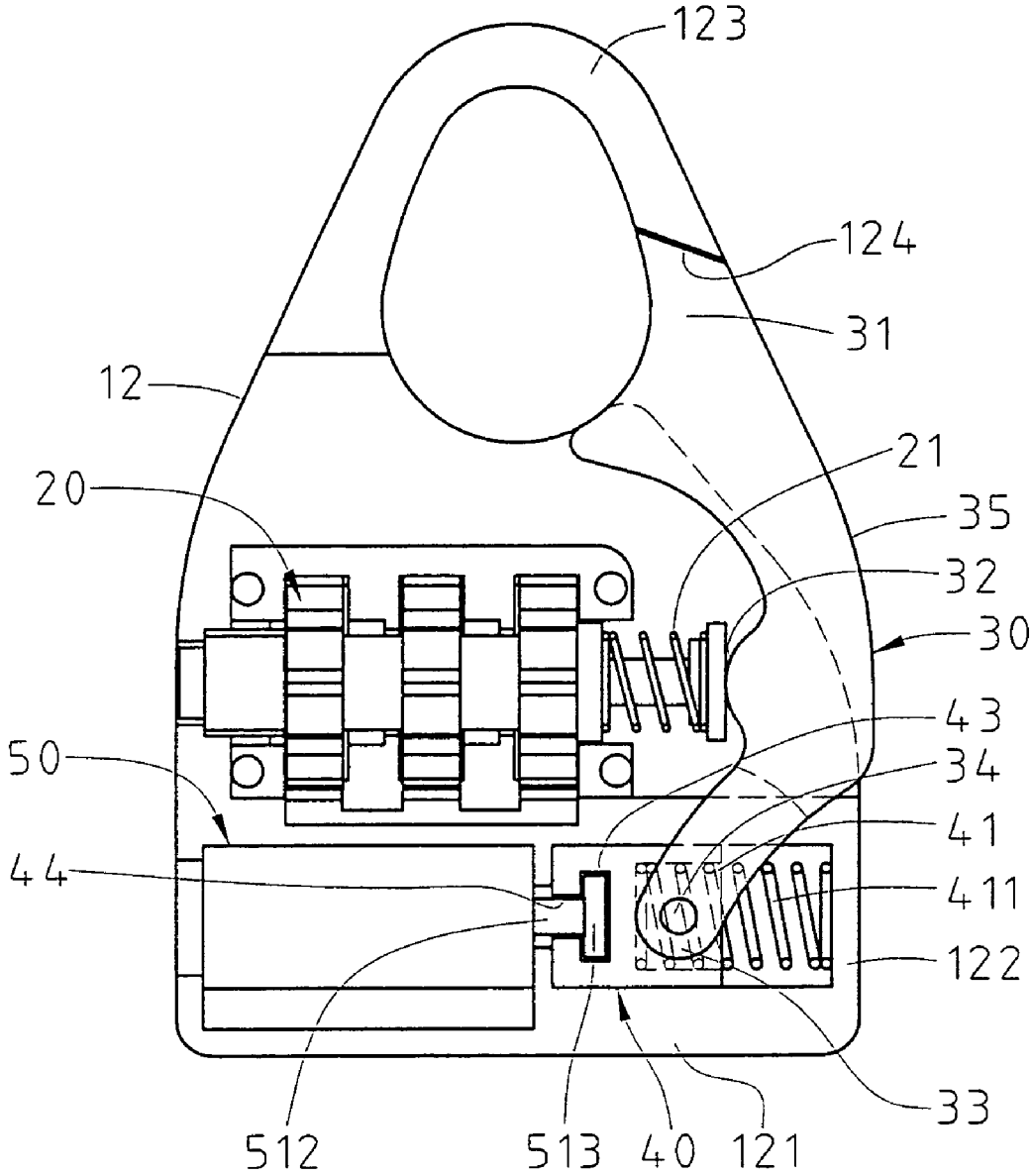
FIG. 3 is a top plan view of the combination lock of FIG. 2 where a cover is removed for showing internal details of the combination lock in a locked position.

Referring to FIG. 3, there is shown a locked position of the combination lock in which the spring 21 is expanded to push the second shackle 30 outwards with the outer arm 31 matingly engaged with the open end 124. That is, pressing the trigger portion 35 will not compress the spring 21 to open the combination lock since the combination is not correct.

Figure 4:
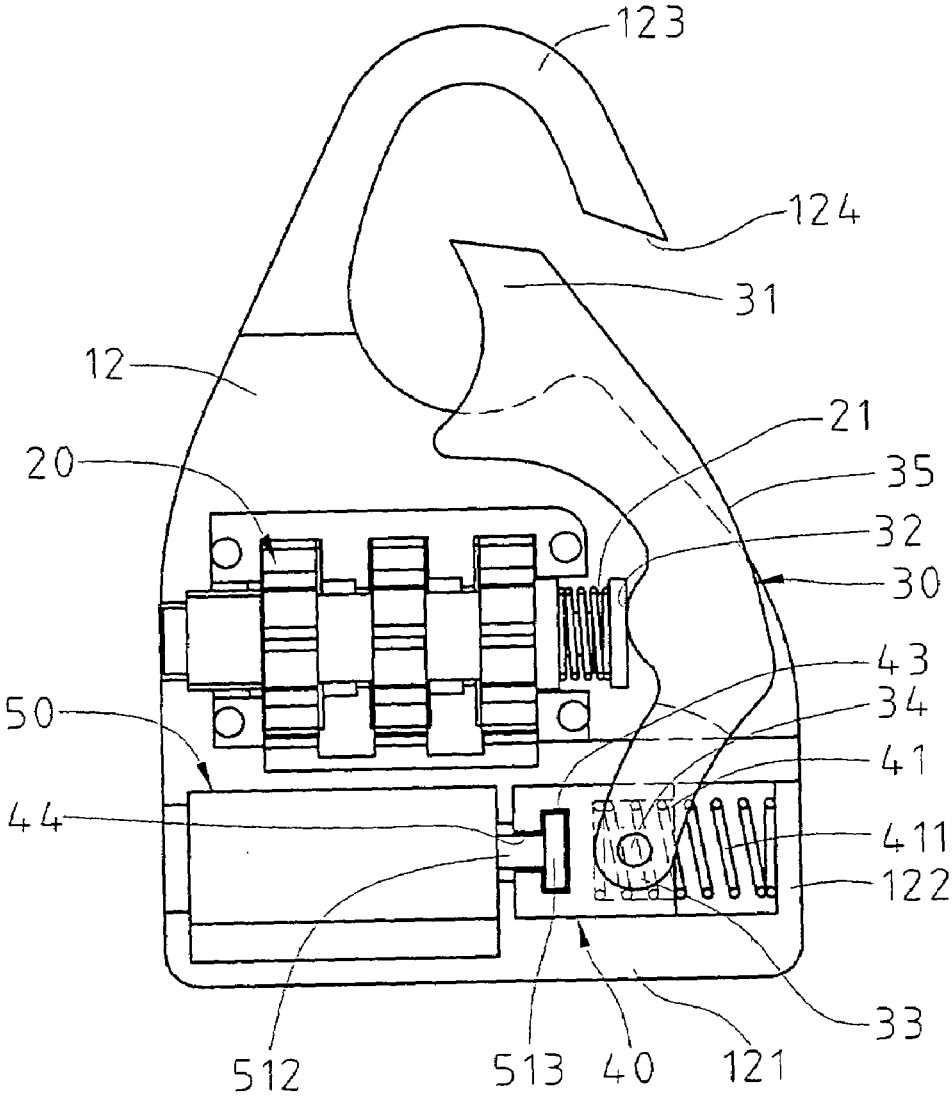
FIG. 4 is a view similar to FIG. 3 where second shackle has been pressed to disengage from first shackle in response to a correct combination of dials.

Referring to FIG. 4, in response to a correct combination of the dial assembly 20 pressing the trigger portion 35 will cause the convex portion 32 to compress the spring 21 due to a counterclockwise pivotal operation of the outer arm 31 (i.e., the second shackle 30) about the pin 42. As a result, the outer arm 31 is disengaged from the open end 124 for opening the combination lock.

Figure 5:
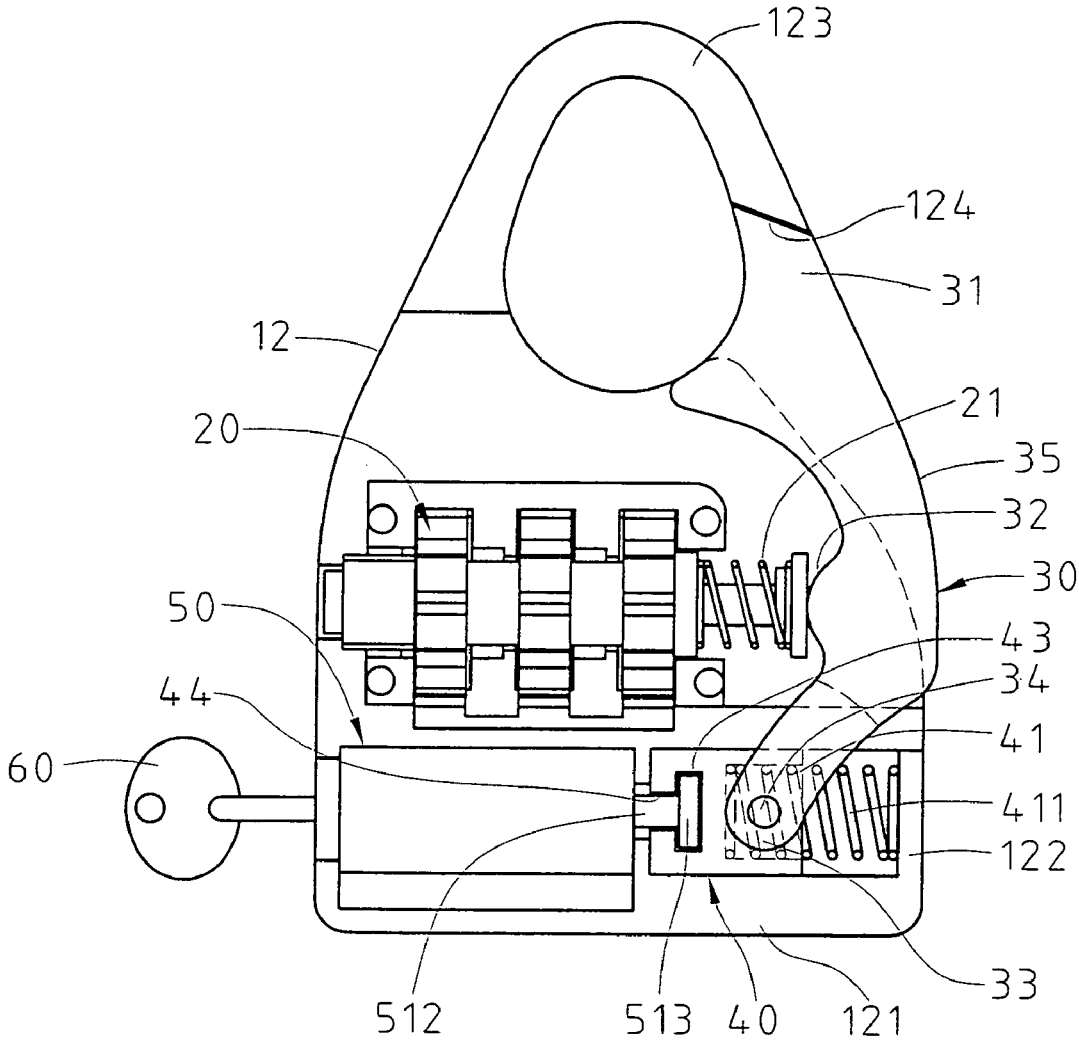
FIG. 5 is a view similar to FIG. 3 where the second shackle is not adapted to press to disengage from the first shackle due to incorrect combination of the dials and key is inserted into a keyhole of key opening mechanism.

Referring to FIG. 5, there is shown the locked combination lock in which the cross member 513 is confined in the slot 43 (i.e., the moveable block 40 is immoveable). As such, pressing the trigger portion 35 still cannot compress the spring 21 to open the combination lock since the combination is not correct.

Figure 6:
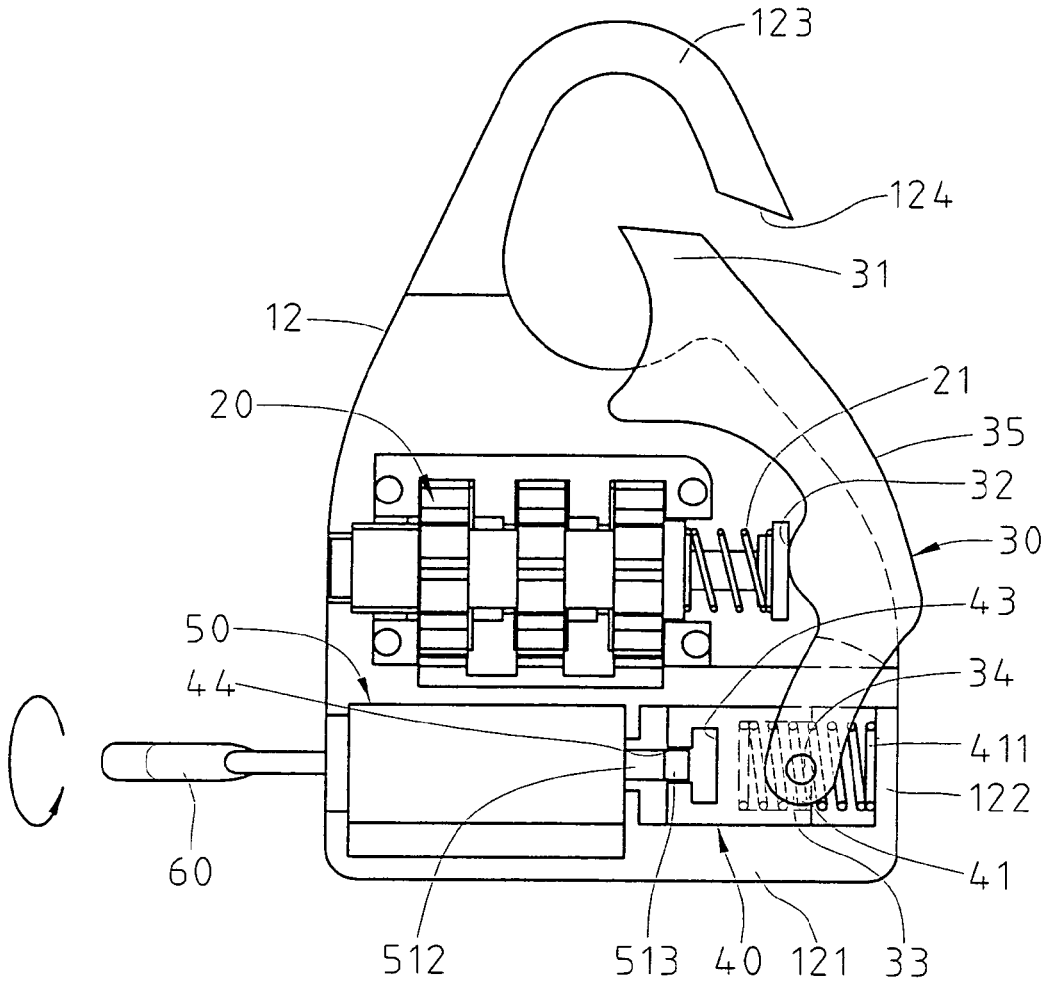
FIG. 6 is a view similar to FIG. 5 where the key has been turned to work the key opening mechanism that opens the combination lock in response to an incorrect combination of the dials.

Referring to FIG. 6, in a case of forgetting of the correct combination a user may insert a key 60 into the keyhole 51. Next, turn the key 60 to work the key opening mechanism 50 to cause the shaft 512 and thus the cross member 513 to rotate. Once the cross member 513 is aligned with the opening 44, pressing the trigger portion 35 will cause the inner arm 33 to counterclockwise pivot about the spring 21 (i.e., the convex portion 32). And in turn, the pin 42 (i.e., the moveable block 40) moves toward the second wall 122 to compress the spring 411 due to the pivotal coupling of the pin 42 and the inner arm 33 at the hole 34. At the same time, the opening 44 moves outwardly for permitting the cross member 513 to dispose therein. As an end, the outer arm 31 is disengaged from the open end 124 for opening the combination lock.

While the invention herein disclosed has been described by means of specific embodiments, numerous modifications and variations could be made thereto by those skilled in the art without departing from the scope and spirit of the invention set forth in the claims.

What is claimed is:

1. A combination lock comprising:

a housing comprising a cover having a plurality of first openings, and a base matingly coupled to the cover, the base including a recess, a first cavity besides the recess, a second cavity aligned with and being in communication with the first cavity, and an extended first shackle;

a dial assembly disposed in the recess and comprising a plurality of parallel dials partially projected from the first openings of the cover, each dial having a plurality of distinct indicia formed on its outer surface, and a spring loaded member biased against the innermost dial, the spring loaded member being moveable in response to a correct combination of the dials;

a second shackle comprising an outer arm matingly engaged with an end of the first shackle when the lock is locked, an inner, intermediate convex portion biased against the spring loaded member, an inner arm extended above the second cavity, a hole formed at one end of the inner arm, and an outer, intermediate trigger portion;

a moveable block disposed in the second cavity and comprising a top pin inserted into the hole for forming a pivotal coupling to the second shackle, an aperture having a blind end, a resilient member received in the aperture and resiliently confined by the second cavity, and a T-shaped slot opposite the aperture, the slot having a second opening; and a key opening mechanism disposed in the first cavity and comprising a keyhole, a protruded, rotatable shaft opposite the keyhole, the shaft being disposed across the second opening when the lock is locked, and a cross member formed at an end of the shaft, the cross member being disposed in the slot when the lock is locked, whereby in response to a correct combination of the dials pressing the trigger portion will cause the convex portion to compress the spring loaded member, counterclockwise pivot the outer arm about the pin, and disengage the outer arm from the first shackle; and inserting a key into the keyhole and turning the key will rotate both the shaft and the cross member until the cross member is aligned with the second opening such that subsequently pressing the trigger portion will cause the inner arm to counterclockwise pivot about the spring loaded member, move the moveable block outwards to compress the resilient member and move the second opening until the cross member disposes therein, and disengage the outer arm from the first shackle.

2. The combination lock of claim 1, wherein the resilient member is a coil spring.

3. The combination lock of claim 1, wherein the moveable block is a parallelepiped.

* * * * *